US006467739B1

(12) United States Patent
Jou

(10) Patent No.: US 6,467,739 B1
(45) Date of Patent: Oct. 22, 2002

(54) ADJUSTABLE DEVICE FOR ADJUSTING LENGTH OF FOLDABLE TABLE LEG

(76) Inventor: Yuh-Chiou Jou, No. 42, Ying-Shih Road, Ban-Chyau, Taipei Hsien (TW)

( * ) Notice: Subject to any disclaimer, the term of this patent is extended or adjusted under 35 U.S.C. 154(b) by 0 days.

(21) Appl. No.: 09/650,661

(22) Filed: Aug. 30, 2000

(51) Int. Cl.[7] ..... F16M 11/38

(52) U.S. Cl. ..... 248/166; 248/188.5

(58) Field of Search ..... 248/166, 677, 248/617, 125.8, 172, 439, 188.1–188.2, 188.8, 188.5, 528–529, 274.1, 295.11, 297.31, 351, 354.1, 354.5, 354.6, 354.7, 220.21, 221.11, 222.11, 251, 259–260, 222.13, 222.51, 228.1, 228.2, 231.31; 211/105.3, 105.5, 105.6; 403/321, 325–327

(56) References Cited

U.S. PATENT DOCUMENTS

| | | | | | |
|---|---|---|---|---|---|
| 1,890,423 | A | * | 12/1932 | Teagarden | |
| 2,506,508 | A | * | 5/1950 | Kmita | |
| 3,330,421 | A | * | 7/1967 | Simmons | |
| 3,370,817 | A | * | 2/1968 | Weber et al. | |
| 3,474,997 | A | * | 10/1969 | Hinrichsen | |
| 3,583,743 | A | * | 6/1971 | Newell | 248/354 |
| 3,848,851 | A | * | 11/1974 | Elias | 248/354 |
| 4,375,934 | A | * | 3/1983 | Elliott | 248/354 |
| 4,856,747 | A | * | 8/1989 | Gano | 248/354.7 |
| 5,525,000 | A | * | 6/1996 | Belobraydich et al. | 403/102 |
| 5,720,522 | A | * | 2/1998 | Habeck | 248/188.5 |
| 5,813,647 | A | * | 9/1998 | Chen | 248/354.7 |
| 5,873,552 | A | * | 2/1999 | Skarp | 248/161 |
| 5,893,676 | A | * | 4/1999 | Yamamoto et al. | 403/325 |
| 5,924,660 | A | * | 7/1999 | Marron | 248/165 |
| 5,979,854 | A | * | 11/1999 | Lundgren et al. | 248/354.3 |
| 6,019,337 | A | * | 2/2000 | Brown | 248/354.5 |
| 6,032,908 | A | * | 3/2000 | Hillstrom et al. | 248/158 |
| 6,050,531 | A | * | 4/2000 | Wilcox | 248/188.5 |
| 6,056,250 | A | * | 5/2000 | Hillstrom et al. | 248/127 |

FOREIGN PATENT DOCUMENTS

| | | | | |
|---|---|---|---|---|
| DE | 729160 | * | 11/1942 | 248/188.5 |
| DE | 1081243 | * | 5/1960 | 248/188.5 |
| SE | 123815 | * | 1/1949 | 248/188.5 |

* cited by examiner

*Primary Examiner*—Daniel P. Stodola
*Assistant Examiner*—Jennifer E. Novosad

(57) ABSTRACT

An adjustable device for adjusting a length of a foldable table leg. The adjustable device covers the upper side of a support frame and comprises a mounting plate, a control rod and an auxiliary spring. The center of the spring resists against the control rod. An adjusting rod is located on the bottom of the support frame. Adjusting holes are formed along the inner bottom of the adjusting rod. Therefore, when one end of the control rod is pressed down and after a hook end of the control rod lifts upwards, the hook of the control rod is disengaged from the adjusting hole of the adjusting rod, enabling the adjusting rod to be adjusted to have an appropriate length. After the control rod is released, the restoring force of the spring causes the control rod to fit into another adjusting hole to accommodate uneven floor surface.

2 Claims, 6 Drawing Sheets

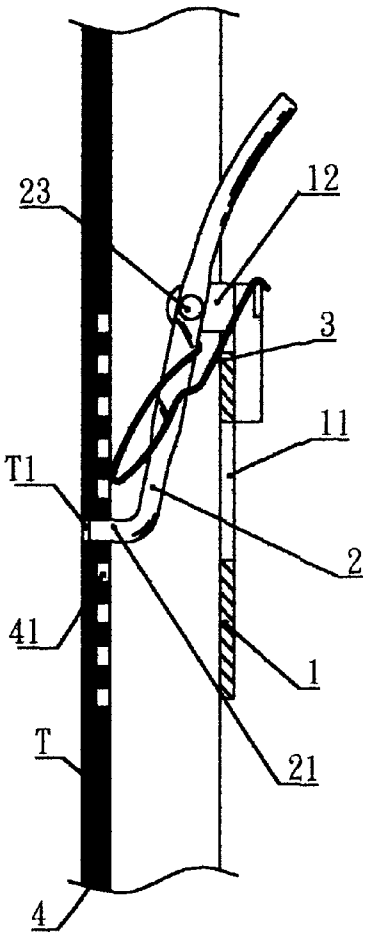
FIG3-A
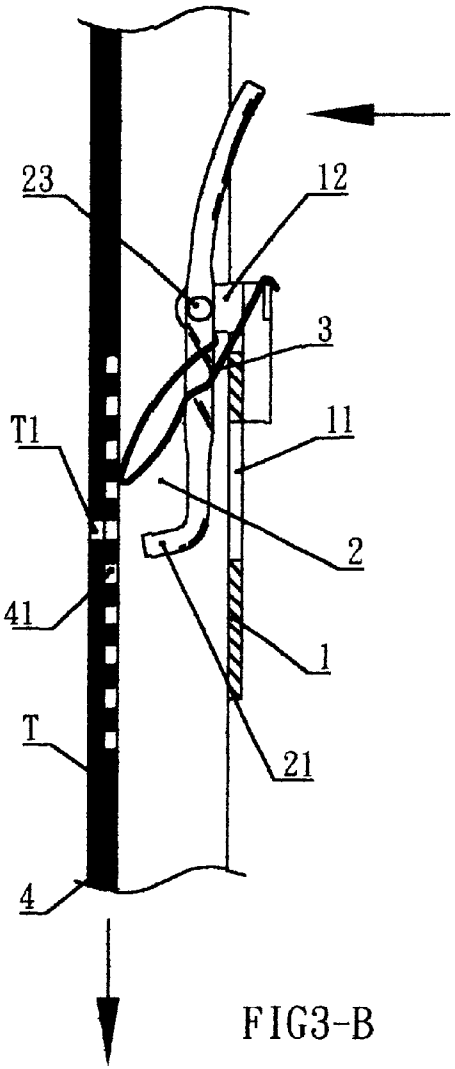
FIG3-B

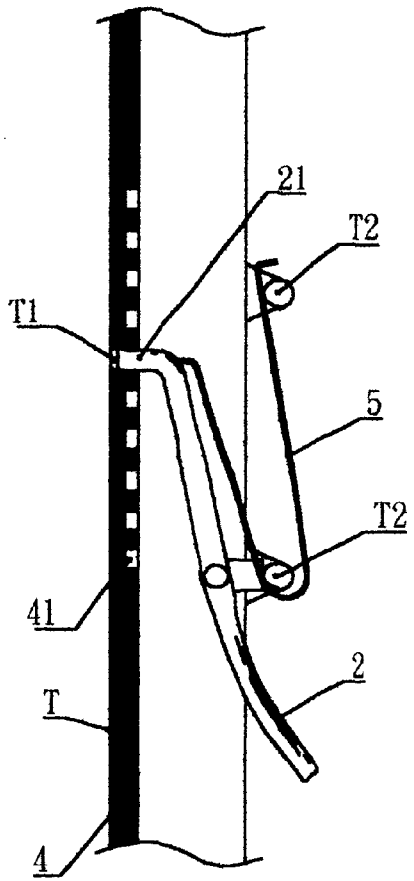
FIG5-A
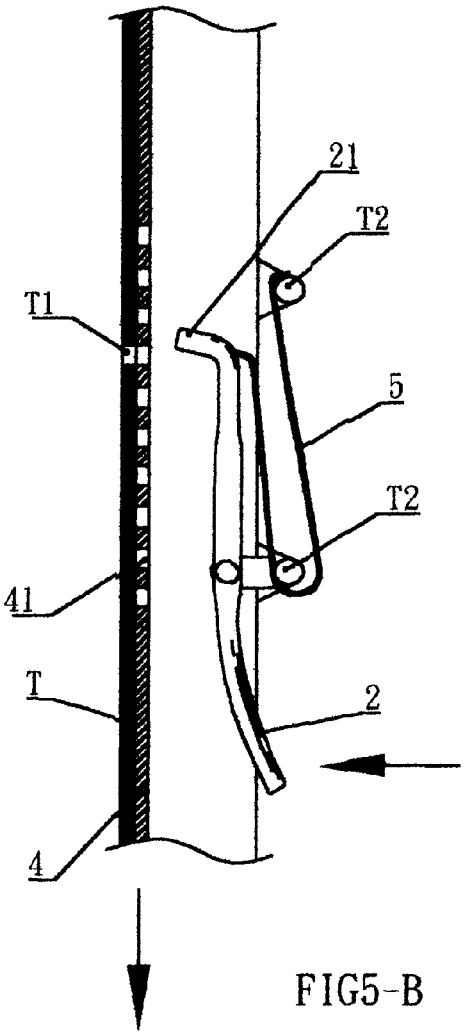
FIG5-B

ADJUSTABLE DEVICE FOR ADJUSTING LENGTH OF FOLDABLE TABLE LEG

BACKGROUND OF THE INVENTION

1) Field of the Invention

The present invention relates to adjustable devices, and particularly to an adjustable device for adjusting a length of a foldable table leg which is suitable for an uneven floor surface such that a table does not tilt.

2) Description of the Prior Art

FIG. 6 shows a conventional foldable leg structure disclosed in Taiwan Patent No. 84,213,902. In this prior art, all the table legs are of a fixed length which can not be adjusted. Thereby, after the height of the table is set, if the floor surface is uneven, then the table is unstable, producing unequal distributed forces applied on the table and resulting in the tilting and instability of the table. To solve this problem, users generally place paperboards, bricks, or other objects under a table leg. Since finding a temporary object having an exact size to match uneven floor surface is not easy, the defect in this prior art cannot be well resolved. Thereby, it left an unbeautiful outlook. Furthermore, with such table leg elevating objects, since the entire center of gravity of the table is maintained by all table legs as well as at the elevating object supporting position, if the elevating object suffers from an impact by an external force, it then moves. The entire table would slide or tilt, so that articles placed on the table will slide down and are easily damaged.

SUMMARY OF THE INVENTION

The primary objective of the present invention is to provide an adjustable device for adjusting a length of a foldable table leg. The adjusting device covers the upper side of the support frame and comprises a mounting plate, a control rod and an auxiliary spring. The center of the spring resists against the control rod. An adjusting rod is located on the bottom of the support frame. Adjusting holes are formed along the inner bottom of the adjusting rod. Therefore, when one end of the control rod is pressed down and, furthermore, after a hook end of the control rod lifts upwards, the hook of the control rod disengages from the adjusting hole of the adjusting rod, enabling the adjusting rod to be adjusted upward or downward to an appropriate length. After the control rod is released, the restoring force of the spring causes the control rod to fit into another adjusting hole to accommodate uneven floor surface.

To enable the examination committee a further understanding of the structural arrangement of the present invention along with its structural features and operating details, the brief description of the drawing below are followed by the detailed description of the present invention.

BRIEF DESCRIPTION OF THE DRAWINGS

FIG. 3A shows the adjusting operation of the present invention.

FIG. 3B shows another adjusting operation of the present invention.

FIG. 5A shows the adjusting operation in another embodiment of the present invention.

FIG. 5B shows another adjusting operation in another embodiment of the present invention.

DETAILED DESCRIPTION OF THE INVENTION

Figure 1:
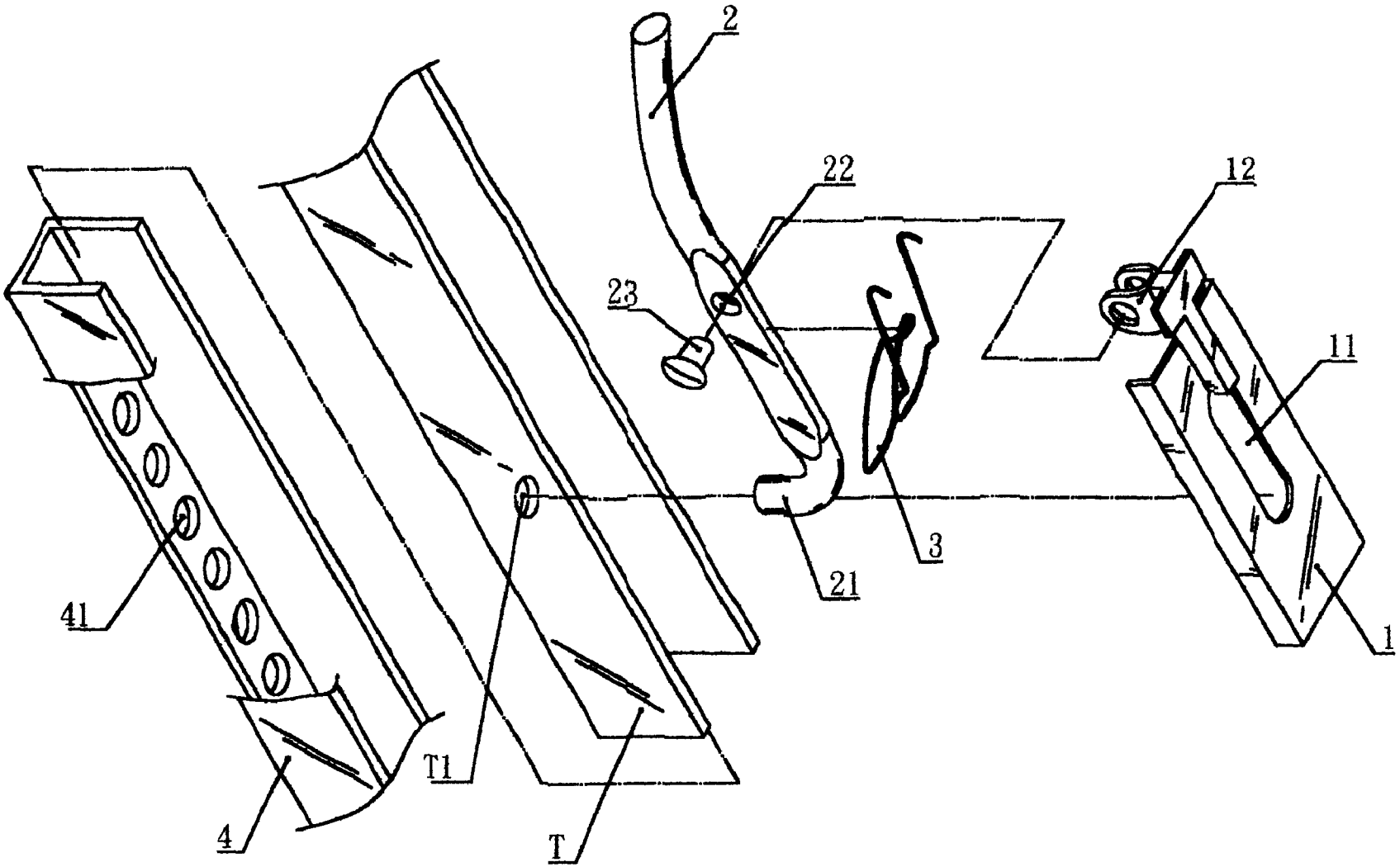
FIG. 1 is an exploded view of the present invention.
Figure 2:
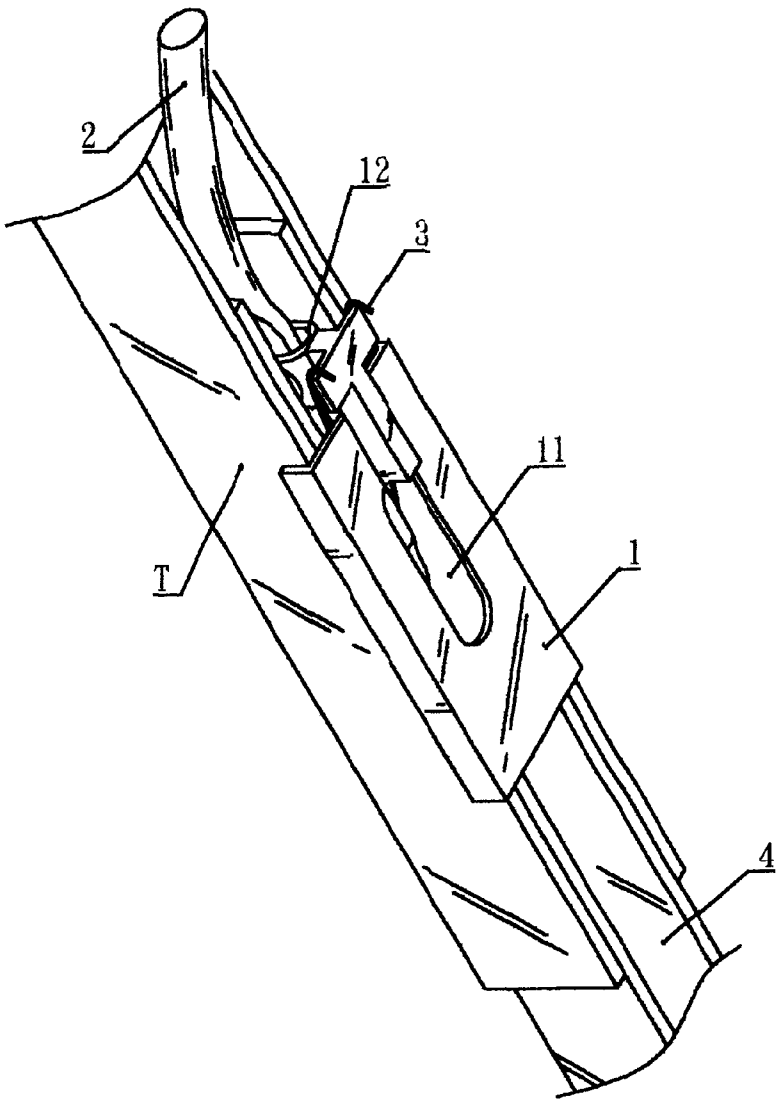
FIG. 2 is an assembled perspective view of the present invention, wherein the device of the present invention is located horizontally.

Referring to FIG. 1 and FIG. 2, the structural features of the present invention are illustrated. The present invention is related to an adjustable device for adjusting a length of a foldable table leg. The adjustable structure is assembled in a support frame and comprises a mounting plate 1 fixed to the upper side of a support frame T, a control rod 2 having a center section pivotably installed to the mounting plate 1 and fastened to the inner side of the mounting plate 1, and an auxiliary spring 3 having a center resisting against the upper side of the control rod 2, an adjusting rod 4 being installed to the inner sides of the support frame T. Furthermore, adjusting holes 41 are formed along the inner lateral surface of the adjusting rod 4 for engaging the control rod 2.

Two vertical sides of the mounting plate 1 are directly positioned on the support frame T. A slot 11 is formed above the plate body. Thereby, as the control rod 2 is lifted, the raised end thereof can be used. A pivot mount 12 is disposed at the front end of the mounting plate 1 for installing the center section of the control rod 2 to the middle of the pivot mount 12 by using an insertion pin 23.

One end of the control rod 2 is bent downwards to form as a vertical hook 21. The pivotal hole 22 at the middle section of the control rod 2 is inserted by a pin 23 so as to pivotally connect the control rod to the pivotal mount 12. Thereby, the two ends of the pivotal section 13 at the midpoint of the control rod 2 may move upwards and downwards.

The auxiliary spring 3 is buckled at the inner side of the mounting plate I and the center thereof resists against the upper side of the control rod 2 such that when one end of the control rod 2 is pressed downwards, the hook 21 of the control rod 2 pushes the auxiliary spring 3 so that the spring is lifted upward, being thereby disengaged from the adjusting hole 4. After the control rod 2 is released, the restoring force of the auxiliary spring 3 pushes the control rod 2 back to its original position.

The adjusting rod 4 is buckled to the inner sides of the support frame T. The adjusting holes 41 are formed on the bottom end of the rod body. Thereby, in normal condition, the hook 21 of the control rod 2 of the positioning rod exactly passes through the adjusting rod 41 and the through hole Ti of the supporting frame so as to set the length of the adjusting rod 4.

Referring to FIG. 3, as pressing down one end of the control rod 2, the hook 21 of the control rod 2 will push the auxiliary spring 3 to lift the spring upward. After the hook 21 is disengaged from the adjusting hole 41, the adjusting rod 4 can be adjusted upwards or downwards to an appropriate length (as shown in FIG. 3B) to match the uneven floor surface. After the control rod 2 is released, the restoring force of the auxiliary spring 3 returns the control rod 2 to the original position, enabling the hook 21 of the control rod 2 to be engaged into another adjusting hole 41 (as shown in FIG. 3A) and thereby accommodate the uneven floor surface such that a table is maintained stably and firmly on the support frames.

Figure 4:
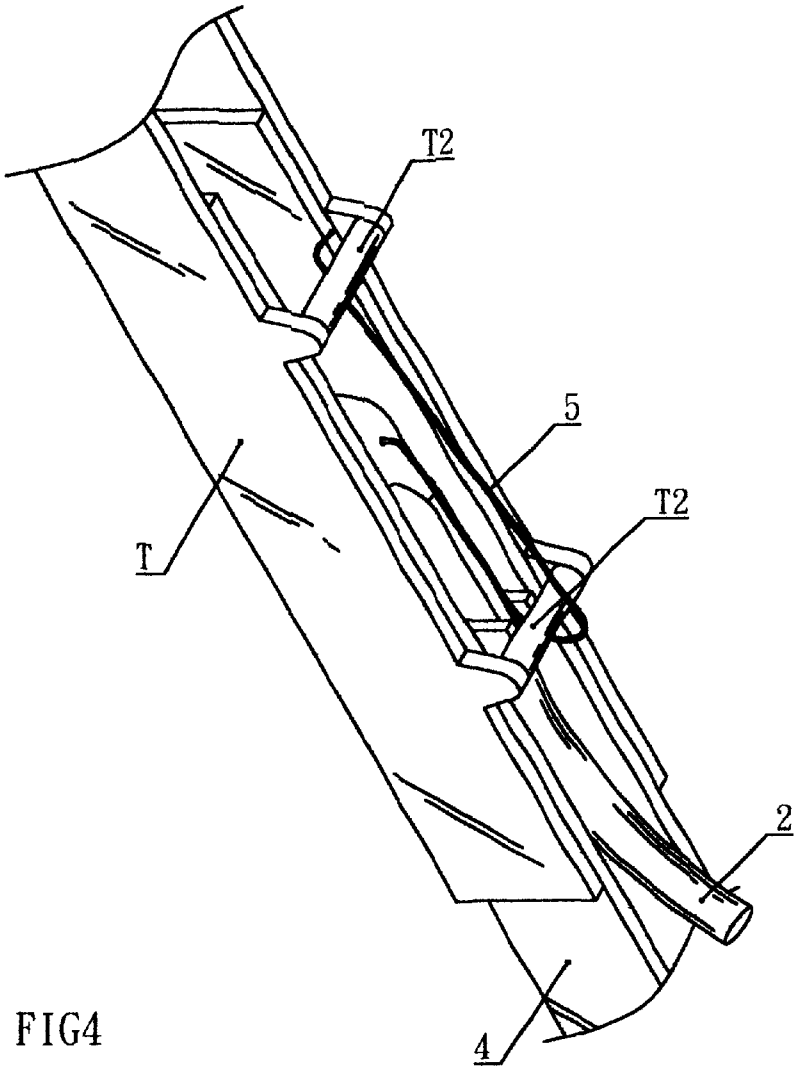
FIG. 4 shows another embodiment of the present invention.
Figure 6:
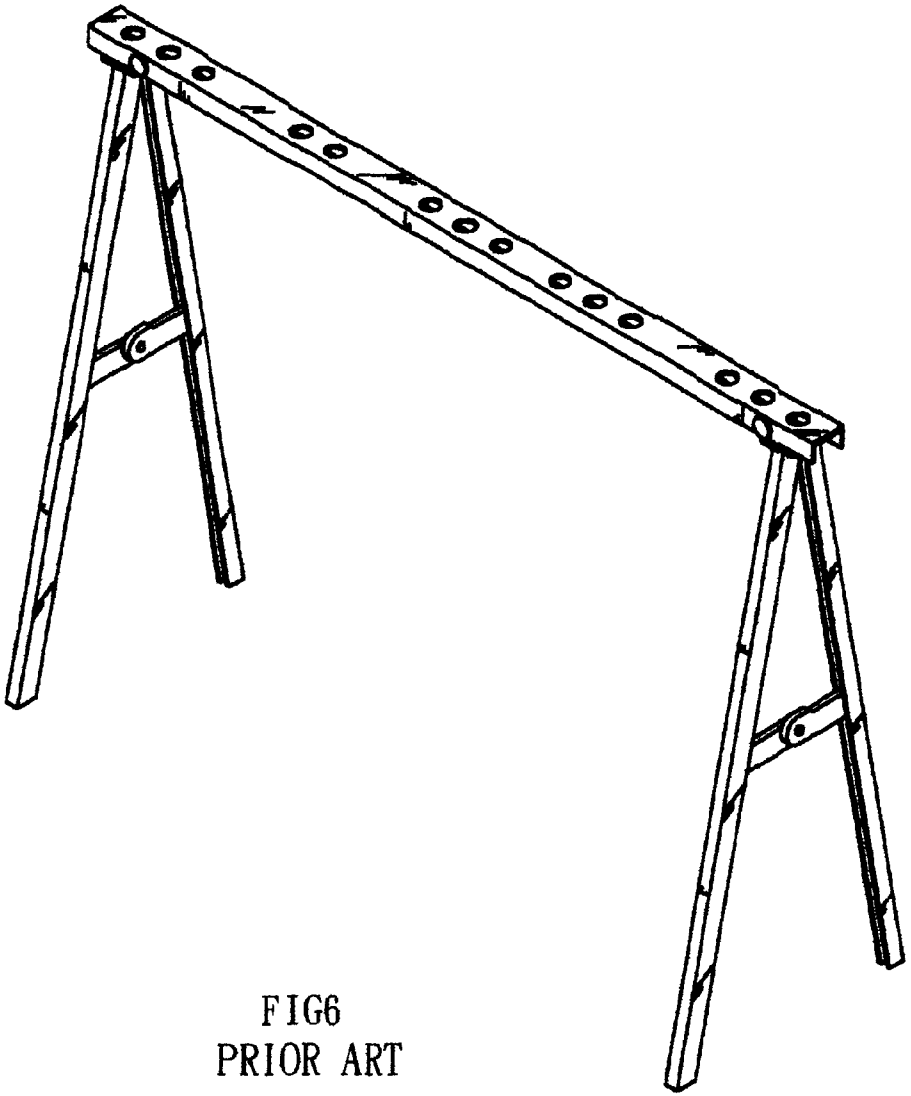
FIG6 PRIOR ART
FIG. 6 shows an embodiment of the prior art for adjusting the leg of a table.

Referring to FIG. 4 and FIG. 5, another embodiment of the present invention consists of two support rods T2 horizontally situated on a support frame T. The control rod 2 is pivotably installed to the inner sides of the adjusting rod 4; a tensional spring 5 is positioned under tension between the control rod 2 and the support rod T2, and one end of the tensional spring 5 is directly inserted into the upper extent of the control rod 2 and the other end is clipped to the bottom end of the support rod T2 such that the control rod 2 is pressed into position against the support rod T2. As a result, when one end of the control rod 2 is pressed down, the control rod 2 pushes upwards against the tensional spring 5 and after it is disengaged from the adjusting hole 41 of the adjusting rod 4, the adjusting rod 4 is adjusted upward or downward to an appropriate length (as indicated in FIG. 5B) to match uneven floor surface. After the control rod 2 is released, the restoring force of the spring pushes the control rod 2 back to original position and causes the hook 21 to be engaged with another adjusting hole 41 (as shown in FIG. 5A) and thereby accommodate the uneven floor surface such that a table is maintained stably and firmly on the support frames over the floor.

What is claimed is:

1. An adjustable device for adjusting a length of a foldable table leg comprising:

a mounting plate having two vertical sides at two vertical edges directly positioned on a support frame formed by two vertical plates extending from a bottom plate, and a pivot mount disposed at an end of the mounting plate;

a control rod having a hook at one end and an opposite end; a center of the control rod being pivotally mounted to the pivot mount of the mounting plate by a screw, and the control rod being located below said mounting plate and above said support frame, whereby the control rod being capable of moving upwards and downwards;

an auxiliary spring buckled into an inner side of the mounting plate and located below an upper side of the mounting plate and above said control rod; and a center portion of the auxiliary spring being disposed against an upper side of the control rod; and an adjusting rod disposed in an interior of the support frame; the adjusting rod having a plurality of adjusting holes formed along a bottom surface of the adjusting rod whereby the control rod is pivotally engaged into the adjusting rod by the hook of the control rod being inserted into one of the plurality of adjusting holes such that the hook of the control rod is inserted into one of the plurality of adjusting holes as well as a through hole of the support frame, thereby setting the length of the adjusting rod;

wherein as the opposite end of the control rod is pressed downwards, the hook of the control rod will be disengaged front the one of the plurality of adjusting holes and then the adjusting rod can be moved so that the hook is engaged with another one of the adjusting holes so that a table installed with a plurality of the table legs is suitable for an uneven floor surface and thus the table is maintained stably and firmly on the floor surface.

2. The adjustable device for adjusting a length of a foldable table leg as claimed in claim 1, wherein a slot is formed in the mounting plate for receiving the hook of the control rod after the opposite end of the control end has been pressed downwards.

* * * * *